US008801123B2

(12) United States Patent
Kueng

(10) Patent No.: US 8,801,123 B2
(45) **Date of Patent: *Aug. 12, 2014**

(54) FURNITURE FITTING FOR FASTENING A FRONT PANEL

(71) Applicant: Julius Blum GmbH, Hochst (AT)

(72) Inventor: David Kueng, Andelsbuch (AT)

(73) Assignee: Julius Blum GmbH, Hoechst (AT)

( * ) Notice: Subject to any disclaimer, the term of this patent is extended or adjusted under 35 U.S.C. 154(b) by 0 days.

This patent is subject to a terminal disclaimer.

(21) Appl. No.: 13/894,853

(22) Filed: May 15, 2013

(65) Prior Publication Data

US 2013/0249370 A1 Sep. 26, 2013

Related U.S. Application Data

(63) Continuation of application No. PCT/AT2011/000467, filed on Nov. 17, 2011.

(30) Foreign Application Priority Data

Nov. 23, 2010 (AT) ..... 1938/2010

(51) Int. Cl.
*A47B 96/00* (2006.01)
*A47B 88/00* (2006.01)

(52) U.S. Cl.
CPC ..... *A47B 88/0051* (2013.01); *A47B 88/0055* (2013.01)
USPC ..... 312/348.4; 312/265.5

(58) Field of Classification Search
USPC ..... 312/348.4, 348.1, 348.2, 265.5, 330.1, 312/257.1, 263; 403/231, 321, 322.1, 403/322.4, 381, 382, 409.1, 325, 327, 230, 403/319, 320, 329, DIG. 10, DIG. 12, 403/DIG. 13
See application file for complete search history.

(56) References Cited

U.S. PATENT DOCUMENTS 4,846,538 A * 7/1989 Rock et al. ..... 312/263
4,902,080 A * 2/1990 Berger ..... 312/348.4

(Continued)

FOREIGN PATENT DOCUMENTS

AT 399 086 3/1995
AT 509 411 8/2011

(Continued)

OTHER PUBLICATIONS

International Search Report (ISR) issued Mar. 20, 2012 in International (PCT) Application No. PCT/AT2011/000467.

(Continued)

*Primary Examiner* — Daniel Rohrhoff
(74) *Attorney, Agent, or Firm* — Wenderoth, Lind & Ponack, L.L.P.

(57) ABSTRACT

A furniture fitting for attaching a front panel to a drawer frame includes a fastening device for the front panel that is associated with the drawer frame, and a connecting element that can be mounted on the front panel. The connecting element includes mounting elements, in particular dowels, for fastening to the front panel, and the connecting element can be fastened to the fastening device in a detachable and in particular position-adjustable manner. The connecting element includes a first part and a second part arranged at a distance from the first part in the mounting position, and the first part of the connecting element can be connected to the front panel by at least two mounting elements and the second part of the connecting element can be connected to the front panel by at least two further mounting elements.

12 Claims, 6 Drawing Sheets

(56) References Cited

U.S. PATENT DOCUMENTS

| | | | | |
|---|---|---|---|---|
| 5,163,774 | A * | 11/1992 | Lautenschlager | 403/245 |
| 5,860,718 | A * | 1/1999 | Brustle | 312/348.2 |
| 5,895,103 | A * | 4/1999 | Huber | 312/348.4 |
| 6,412,893 | B1 * | 7/2002 | Muterthies et al. | 312/348.1 |
| 6,457,791 | B1 * | 10/2002 | Muterthies et al. | 312/348.4 |
| 7,055,919 | B2 * | 6/2006 | Lam Harn et al. | 312/348.4 |
| 7,540,577 | B2 * | 6/2009 | Netzer | 312/348.4 |
| 8,262,175 | B2 * | 9/2012 | Lam et al. | 312/348.4 |
| 8,297,724 | B2 * | 10/2012 | Hammerle | 312/348.4 |
| 8,727,461 | B2 * | 5/2014 | Holzapfel et al. | 312/348.4 |
| 2010/0102692 | A1 | 4/2010 | Hämmerle | |
| 2012/0286116 | A1 | 11/2012 | Gasser | |
| 2013/0257252 | A1 * | 10/2013 | Holzapfel et al. | 312/348.4 |

FOREIGN PATENT DOCUMENTS

| | | |
|---|---|---|
| EP | 1 084 655 | 3/2001 |
| EP | 1 157 636 | 11/2001 |
| EP | 1 393 653 | 3/2004 |
| WO | 2007/137311 | 12/2007 |
| WO | 2009/006651 | 1/2009 |

OTHER PUBLICATIONS

Austrian Patent Office Search Report (ASR) completed Jun. 29, 2011 in Austrian Patent Application No. A 1938/2010.

* cited by examiner

SCHNITT A-A:

SCHNITT 3-3:

FURNITURE FITTING FOR FASTENING A FRONT PANEL

BACKGROUND OF THE INVENTION

The invention concerns a furniture fitting for mounting a front panel to a drawer frame member, comprising a fastening device for the front panel, the device being associated with the drawer frame member, and a connecting element which can be mounted to the front panel and which has mounting elements, in particular dowels, for fastening to the front panel. The connecting element can be fastened releasably and in particular adjustably in position to the fastening device, and has a first portion and a second portion spaced in relation to the first portion in the mounted position. The invention further concerns a drawer having such a furniture fitting and an article of furniture having a furniture carcass and such a drawer.

The most widely varying technical procedures are already known in the field of mounting front panels to a drawer container, in particular a frame member. In most cases, such a furniture fitting comprises, on the one hand, a connecting element which is associated with the front panel and which remains on the front panel even in the removed condition of the latter. On the other hand, the furniture fitting has a fastening device which is associated with the frame member and to which the connecting element mounted to the front panel is connected. In most cases, arranged in the region of the furniture fitting are adjusting elements which permit direct or indirect positional displacement of the front panel in relation to the frame member.

A furniture fitting of that kind is known from AT 509411 A1 which is published after the relevant date. In particular the structure shown in FIG. 16 in that specification shows a two-part connecting element mounted separately to the front panel. A disadvantage with that configuration is that the respective portions of the connecting element are respectively connected only to a holding projection on the front panel so that they can be relatively easily turned and thus the orientation of the two portions of the connecting element relative to each other is not in conformity with the orientation required for fastening to the actual drawer. In addition, with this construction, stockkeeping is quite complicated and expensive as two mutually different portions have to be kept in stock separately from each other and have to be appropriately correctly associated upon production of the furniture fitting.

SUMMARY OF THE INVENTION

Therefore, the object of the present invention is to provide a furniture fitting which is improved over the state of the art or over the specification of earlier priority. In particular, the invention seeks to provide that the furniture fitting is suitable for front panels of any height. In addition, the invention seeks to provide that stockkeeping of the furniture fitting parts, that is as simple as possible, is enabled. In addition, the invention seeks to provide that the pressing-in force when mounting the connecting element to the front panel can be applied as uniformly as possible to the different mounting elements.

That is achieved for a furniture fitting having the features of the classifying portion, in which the first portion of the connecting element can be connected to the front panel by way of at least two mounting elements and the second portion of the connecting element can be connected to the front panel by way of at least two further mounting elements. In that way, it is possible for the two portions of the connecting element to be fitted in exactly mutually oriented relationship and also to remain in that position on the front panel. In addition, the individual portions of the connecting element can also be fitted to the front panel relatively widely spaced from each other so that it is also possible to fit a very high front panel (for example over 30 cm) to a drawer frame member which is then suitably increased in height. Even in the case of high front panels, this structure affords the advantage of using little material with at the same time non-displaceable fitment of the portions of the connecting element to the front panel.

A preferred embodiment of the present invention can provide that the connecting element has at least two latching elements by way of which the connecting element can be fastened to the fastening device and can be preferably hung therein. The first portion of the connecting element, has the first latching element and the second portion of the connecting element has the second latching element.

In a preferred embodiment of the invention, the two portions of the connecting element are U-shaped in cross-section and have two substantially mutually parallel side plates connected together by a transverse limb. In that case, the respective connecting element is stamped out of a preferably metallic, one-piece, plate-shaped element and bent into shape.

To provide, on the one hand, a sturdy furniture fitting and, on the other hand, a less expensive furniture fitting, preferably the fastening device has a one-piece adjusting plate to which the first and second portions of the connecting element can be fastened. As a result, the furniture fitting—in particular with the front panel fitted—is very rigid. In addition, the height and lateral adjusting means can act on that one portion.

To provide a good hold for the mounting elements to the respective connecting element, the at least two mounting elements are fastened to the transverse limb of the respective portion of the connecting element and project from the side, remote from the side plates, of the transverse limb of the respective portion of the connecting element.

For a simple connection between the connecting element and the fastening device, in the region remote from the transverse limb, the side plates are connected by a preferably metallic pin which forms the latching element of the respective portion of the connecting element. The respective portion of the connecting element can be hung by way of the pin at a respective latching groove of the fastening device.

To provide for particularly simple stockkeeping, the first portion and the second portion of the connecting element are substantially identical. In that respect, "substantially identical" means that the individual portions of the connecting element involve the same dimensions and are produced in the same production process. It will be appreciated that there may be small differences caused by production engineering.

It is particularly important for optimum fastening of the front panel to the frame member if the first portion and the second portion of the connecting element have a fixed non-displaceable positional relationship with each other in the mounted position on the front panel. In that respect, it is particularly important that mounting of the individual portions of the connecting elements is effected in an alignment on the front panel. In other words, the portions of the connecting element are mounted to the front panel in mutually aligned relationship. That also implies that the pre-bores provided in the front panel for the mounting elements should be arranged in a line.

Particularly simple adjustment of the front panel relative to the frame member is achieved if the fastening device has at least two adjusting elements which engage an adjusting plate of the fastening device and by way of which the connecting element together with the front panel is displaceable in respect of position with respect to the fastening device in the heightwise direction and the lateral direction in the condition of being mounted to the fastening device.

The invention is also directed to a drawer having the features described below and an article of furniture having the features described below.

BRIEF DESCRIPTION OF THE DRAWINGS

Further details and advantages of the present invention will be described more fully hereinafter by means of the specific description with reference to the embodiments by way of example illustrated in the drawings, in which.

DETAILED DESCRIPTION OF THE INVENTION

Figure 1:
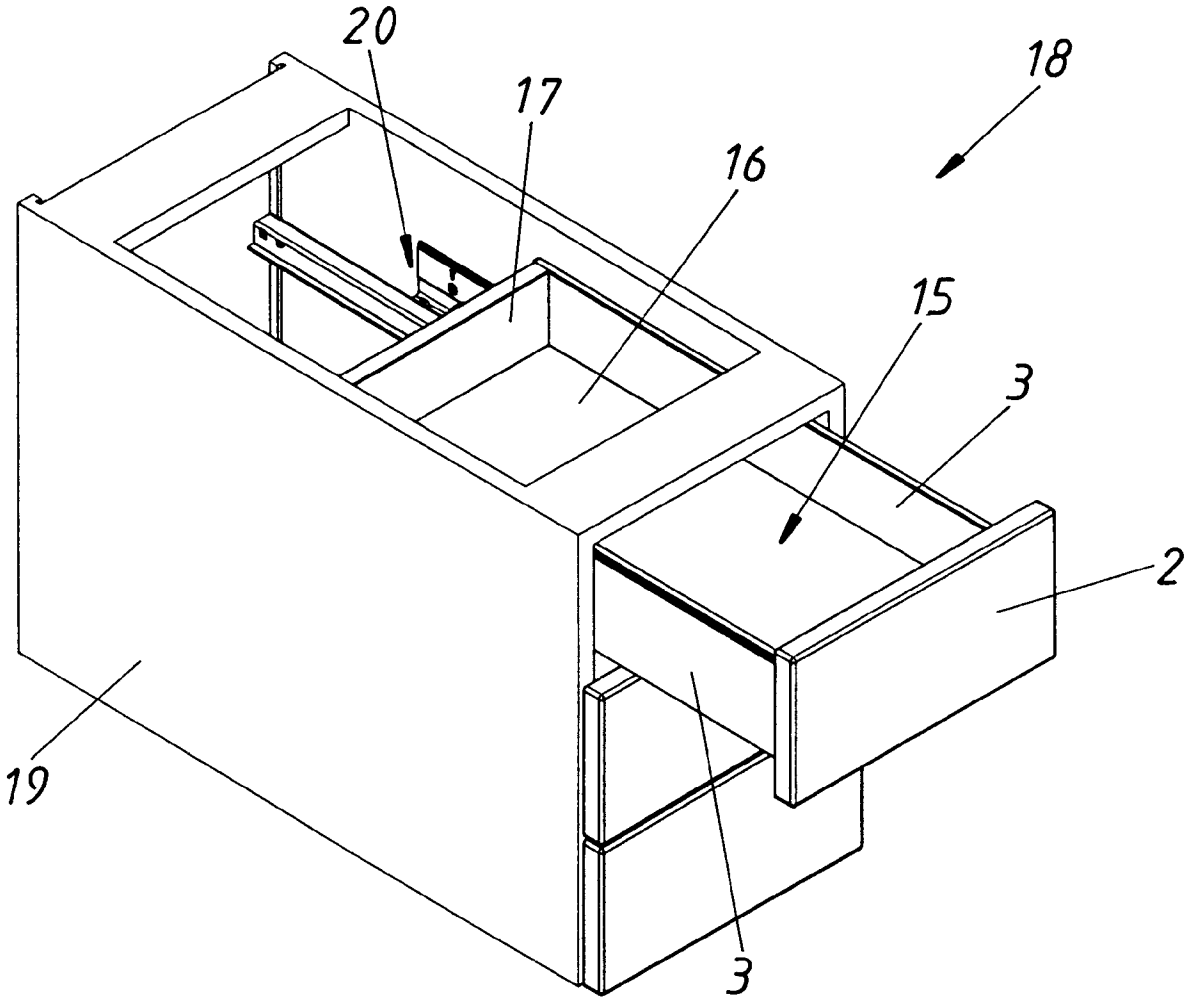
FIG. 1 shows a view of an article of furniture.

FIG. 1 shows an article of furniture 18 comprising a furniture carcass 19 and a furniture part in the form of a drawer 15, which is movable relative to the furniture carcass 19 by way of an extension guide 20. The drawer 15 substantially comprises a drawer bottom, a drawer rear wall 17, two frame members 3 forming the side walls of the drawer, and the front panel 2.

Figure 2:
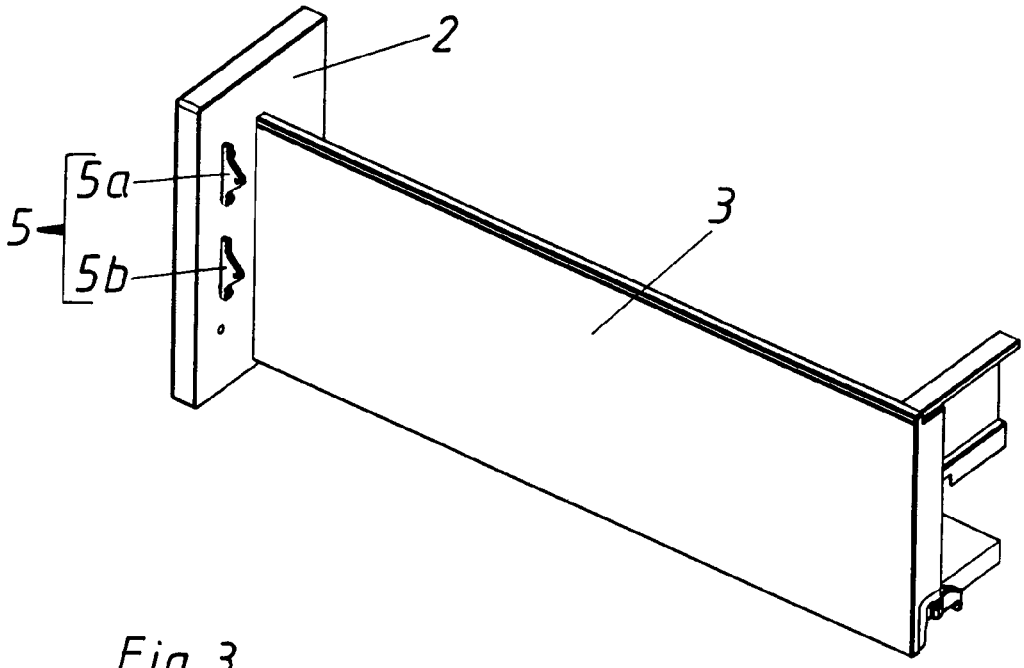
FIG. 2 shows a view of a frame member and a front panel prior to fastening.
Figure 3:
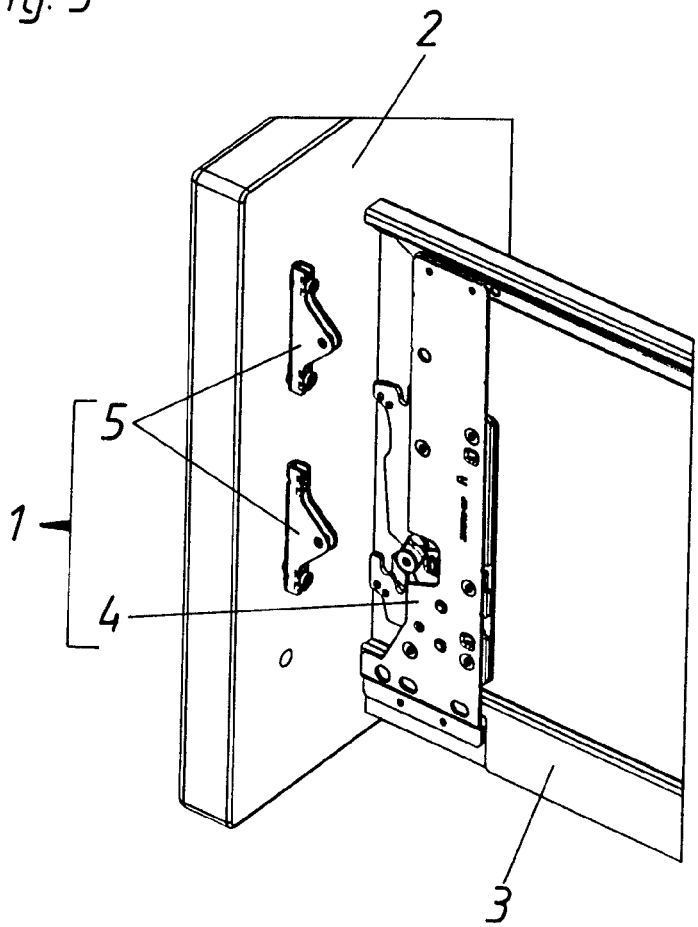
FIG. 3 shows a view of the portions of the furniture fitting, that are not yet connected together.

FIG. 2 shows the portions 5*a* and 5*b* of connecting element 5, which portions 5*a* and 5*b* are arranged in mutually aligned and superposed relationship on the front panel 2 prior to connection of the drawer frame member 3. FIG. 3 shows a broken-away view similar to FIG. 2, illustrating the essential portions of the furniture fitting 1 (two-part connecting element 5 and fastening device 4).

Figure 4:
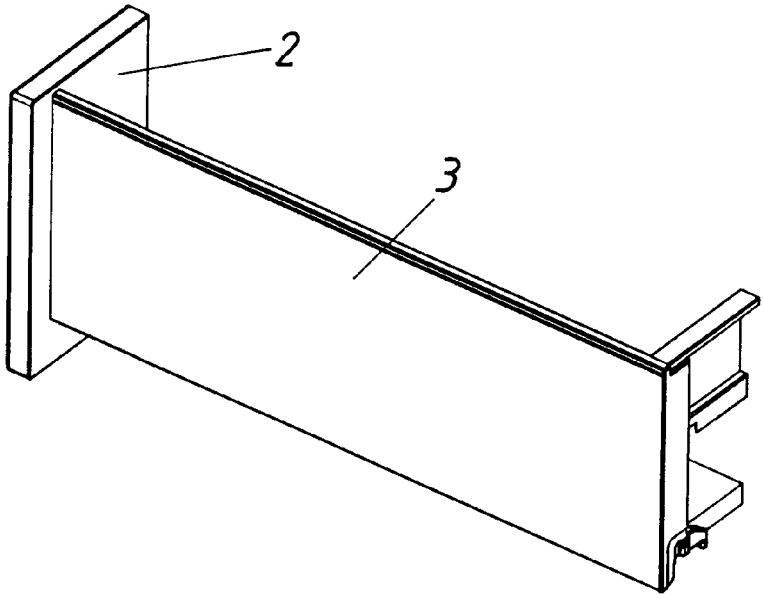
FIG. 4 shows the front panel fitted to the frame member.
Figure 5:
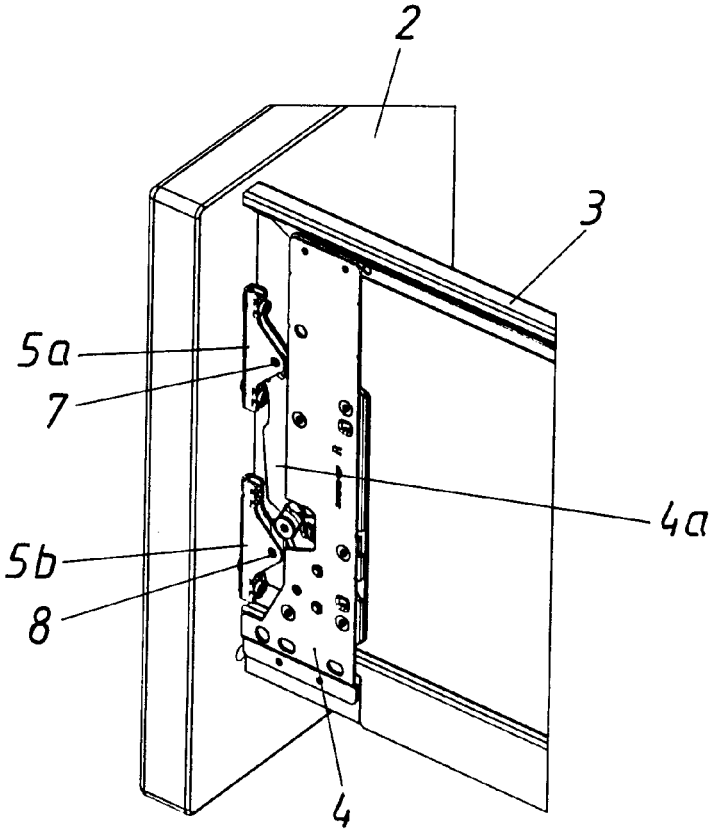
FIG. 5 shows the interconnected portions of the furniture fitting.

In FIG. 4, the front panel 2 is fastened to the drawer frame member 3. In matching relationship therewith, FIG. 5 shows how the first portion 5*a* of the connecting element 5 is hung by way of its latching element 7, and the second portion 5*b* of the connecting element 5 is hung by way of its latching element 8, on corresponding latching grooves 12 on an adjusting plate 4*a* of the fastening device 4.

Figure 6:
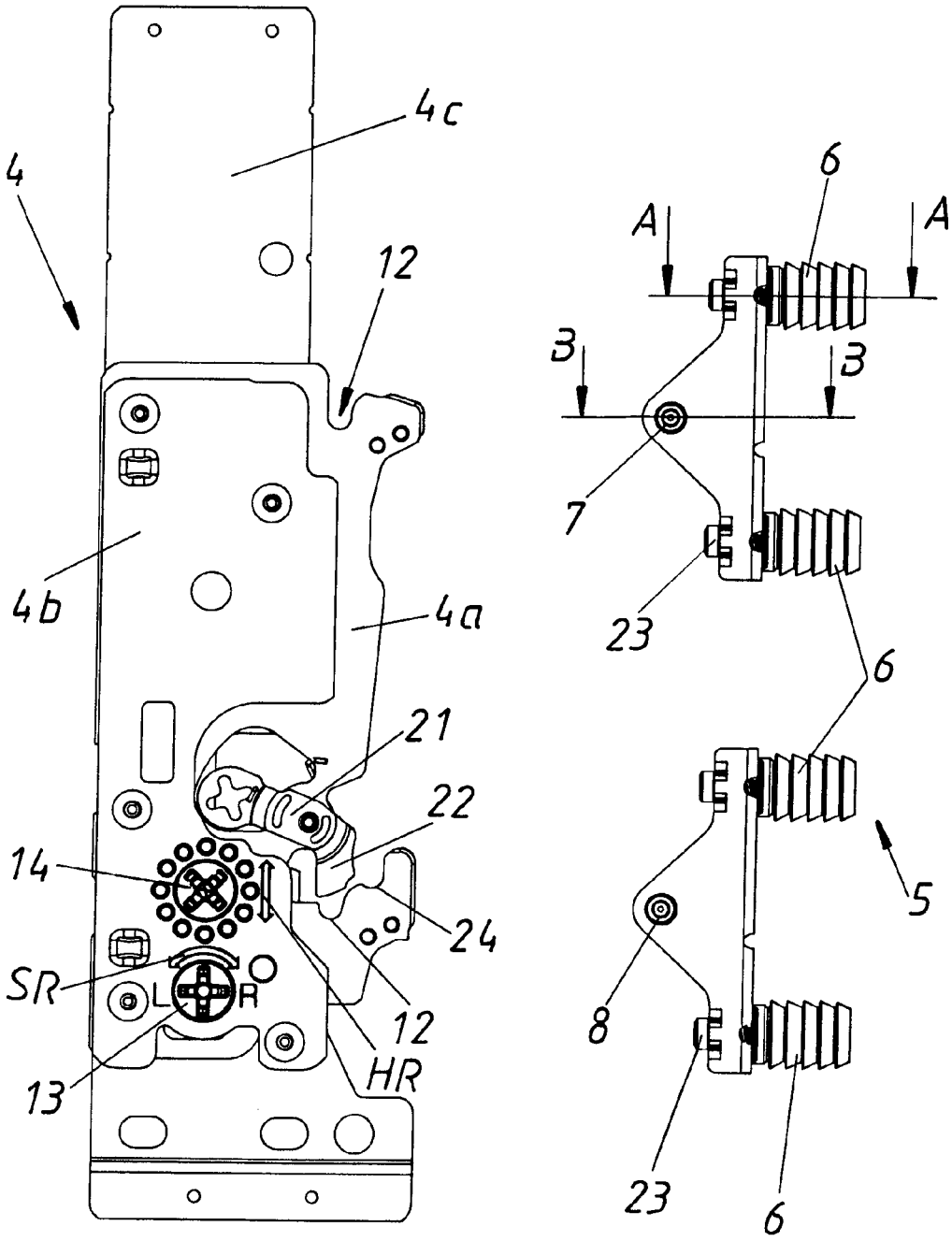
FIG. 6 shows a side view of the fastening device and the portions of the connecting element.

Shown on the right-hand side in FIG. 6 are the portions 5*a* and 5*b* of the connecting element 5, which each have two mounting elements 6 in the form of dowels. In this case, they can each be spread by way of a spreading member 23 which engages into the dowels so as to permit fixing in a corresponding bore in the front panel 2. It will be appreciated that mounting in the form of inserter dowels as is known for example from EP 0 698 357 A1 should also not be ruled out. Other fitment types such as screwing in the individual mounting elements 6 should also not be excluded.

Shown in the left-hand region in FIG. 6 is the fastening device 4 which substantially comprises two frame plates 4*b* and 4*c* and a central adjusting plate 4*a* which is displaceable relative to the frame plates 4*b* and 4*c*. That adjusting plate 4*a* is displaceable with respect to the frame plates 4*b* and 4*c* in the height direction H and in the lateral direction SR by the adjusting elements 13 and 14. Also arranged on the adjusting plate 4*a* is the pivotable locking element 21 which arrests the latching element 8 in the region of the latching groove 12 in the mounted position of the connecting element 5 on the fastening device 4. By pivotal movement of the locking element 21 in the clockwise direction, the locking nose 22 is moved towards the left so that the latching elements 8 (and 7) can be released upwardly from the fastening device 4 by lifting the front panel. To permit the entire front panel 2 to be hung in position by way of the portions 5*a* and 5*b* of the connecting element prior to definitive arresting at the fastening device 4, there is provided the hanging engagement groove 24 on the adjusting plate 4*a*.

Figure 7:
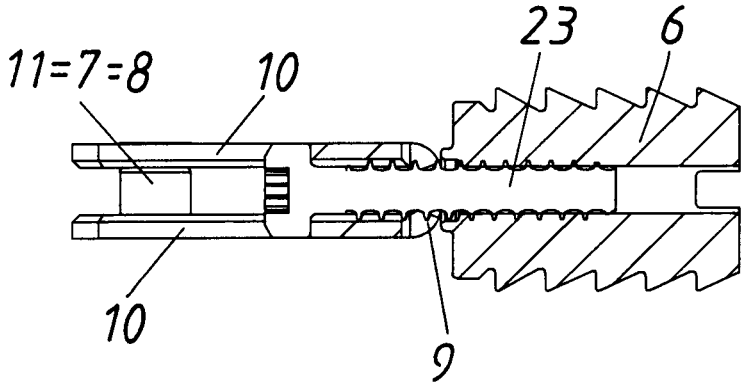
FIG. 7 shows the sections A-A and B-B in FIG. 6.
Figure 7:
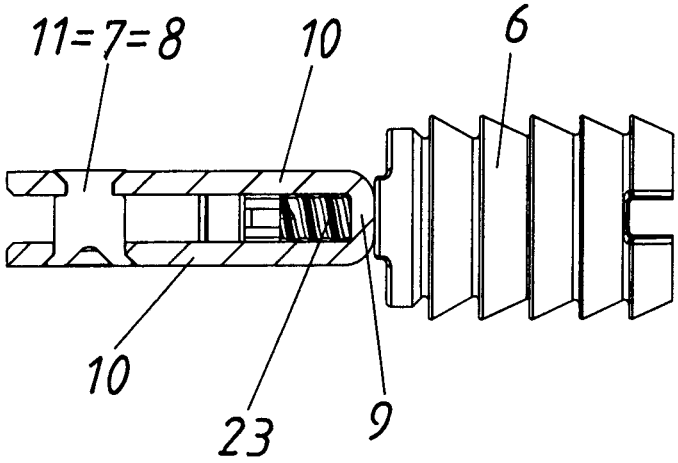

FIG. 7 in the section A-A shows the configuration of the connecting element 5, which is U-shaped in cross-section. The mounting element 6 is fitted in the transverse limb 9 that is reinforced by bending of the side plates 10, by way of the spreading portion 23. The section B-B shows the relatively long side plates 10 which are substantially parallel to each other and which, with the transverse limb 9, form the one-piece metallic base element of each connecting element 5. In the region remote from the transverse limb 9, a pin 11 connects the two side plates 10. Pin 11 is at the same time in the form of a first latching element 7 and a second latching element 8.

Figure 8:
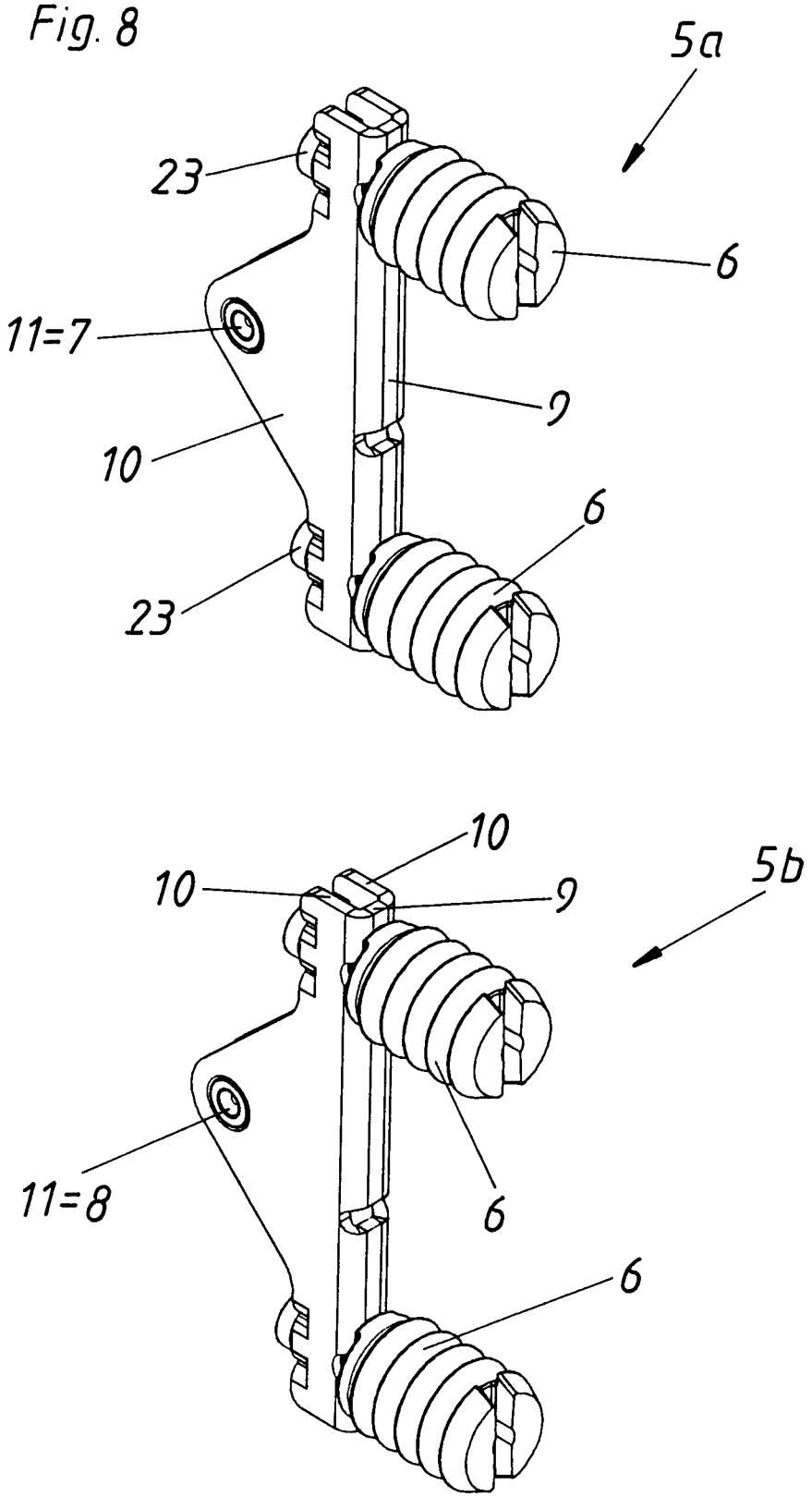
FIG. 8 shows views of the identical portions of the connecting element.

FIG. 8 shows once again the configuration of the first and second portions 5*a* and 5*b* of the connecting element 5, that is of U-shaped cross-section. The mounting elements 6, the spreading portions 23, and the latching elements 7 and 8 are also shown. It will be appreciated that it is not out of the question that more than two mounting elements 6 are provided for each portion 5*a* or 5*b* of the connecting element 5. It will be noted, however, that the structure having precisely two mounting elements 6 per portion 5*a* or 5*b* of the connecting element 5 is the simplest in terms of mounting and also applying a uniform pressing-in force when mounting the connecting element 5 to the front panel 2.

The invention claimed is:

1. A furniture fitting for mounting a front panel to a drawer frame member, said furniture fitting comprising:

a fastening device to be associated with the drawer frame member so as to attach the front panel to the drawer frame member; and a connecting element to be mounted to the front panel and fastened releasably and adjustably in position to said fastening device, said connecting element including:

mounting elements formed as dowels for fastening said connecting element to the front panel;

a first portion to be connected to the front panel by at least two of said mounting elements; and a second portion to be spaced apart from said first portion when mounted to the front panel, said second portion configured to be connected to the front panel by at least an additional two of said mounting elements;

wherein each of said first portion and said second portion has a U-shaped cross-section formed of two substantially mutually parallel side plates connected together by a transverse limb, said side plates being connected by a metallic pin in a location remote from said transverse limb, said pin forming a latching element of each respective one of said first portion and said second portion.

2. The furniture fitting as set forth in claim 1, wherein said latching element of each respective one of said first portion and said second portion are collectively configured to fasten said connecting element to said fastening device by being hung therein, said latching element of said first portion being a first latching element and said latching element of said second portion being a second latching element.

3. The furniture fitting as set forth in claim 1, wherein said at least two of said mounting elements of said first portion are fastened to said transverse limb of said first portion and project from a side of said transverse limb remote from said side plates of said first portion, and said at least an additional two of said mounting elements of said second portion are fastened to said transverse limb of said second portion and project from a side of said transverse limb remote from said side plates of said second portion.

4. The furniture fitting as set forth in claim 1, wherein each respective one of said first portion and said second portion is configured to be hung at a respective latching groove of said fastening device by said latching element formed of said pin.

5. The furniture fitting as set forth in claim 1, wherein said first portion and said second portion of said connecting element are substantially identical.

6. The furniture fitting as set forth in claim 1, wherein the first portion and the second portion of the connecting element have a fixed non-displaceable positional relationship with each other in the mounted position on the front panel.

7. The furniture fitting as set forth in claim 1, wherein said fastening device has at least two adjusting elements for engaging an adjusting plate of said fastening device, said adjusting elements being configured to allow displacement of said connecting element together with the front panel in the heightwise direction and the lateral direction with respect to said fastening device when said connecting element is being mounted to said fastening device.

8. The furniture fitting as set forth in claim 7, wherein said connecting element can be hung by engaging said latching element of each of said first portion and said second portion in latching grooves in said adjusting plate lockably and releasably by a locking element.

9. The furniture fitting as set forth in claim 1, wherein said fastening device has a one-piece adjusting plate.

10. The furniture fitting as set forth in claim 9, wherein said first portion and said second portion are configured to be fastened to said adjusting plate.

11. A drawer comprising:

a drawer bottom;

a drawer rear wall;

two drawer frame members forming drawer side walls;

a front panel; and a pair of furniture fittings each configured as recited in claim 1;

wherein each of said two drawer frame members is connected to said front panel by a respective one of said pair of furniture fittings.

12. An article of furniture comprising:

a furniture carcass; and a furniture part movable relative to said furniture carcass, said furniture part being said drawer of claim 11.

* * * * *